US008502458B2

(12) United States Patent
Huber et al.

(10) Patent No.: US 8,502,458 B2
(45) Date of Patent: Aug. 6, 2013

(54) OPERATING DEVICE AND METHOD FOR THE COMBINED OPERATION OF GAS DISCHARGE LAMPS AND SEMICONDUCTOR LIGHT SOURCES

(75) Inventors: Andreas Huber, Traunreut (DE); Thomas Mudra, Kastl (DE)

(73) Assignee: Osram Gesellschaft Mit Beschraenkter Haftung, Munich (DE)

( * ) Notice: Subject to any disclaimer, the term of this patent is extended or adjusted under 35 U.S.C. 154(b) by 818 days.

(21) Appl. No.: 12/532,151

(22) PCT Filed: Feb. 26, 2008

(86) PCT No.: PCT/EP2008/052290

§ 371 (c)(1),
(2), (4) Date: Sep. 20, 2009

(87) PCT Pub. No.: WO2008/113658

PCT Pub. Date: Sep. 25, 2008

(65) Prior Publication Data

US 2010/0084982 A1 Apr. 8, 2010

(30) Foreign Application Priority Data

Mar. 22, 2007 (DE) ..... 10 2007 013 742

(51) Int. Cl.
*H05B 37/00* (2006.01)

(52) U.S. Cl.
USPC ..... 315/178; 315/182; 315/291; 315/360

(58) Field of Classification Search
USPC ..... 315/178, 182, 246, 247, 250, 291, 315/307, 312, 324, 360
See application file for complete search history.

(56) References Cited

U.S. PATENT DOCUMENTS

| | | | | |
|---|---|---|---|---|
| 7,052,157 | B1 | 5/2006 | Lau | |
| 7,218,056 | B1 * | 5/2007 | Harwood | 315/86 |
| 7,498,753 | B2 * | 3/2009 | McAvoy et al. | 315/291 |
| 7,750,582 | B2 * | 7/2010 | Moriyasu et al. | 315/291 |
| 2002/0118538 | A1 | 8/2002 | Calon et al. | |

(Continued)

FOREIGN PATENT DOCUMENTS

| | | |
|---|---|---|
| CN | 2146829 Y | 11/1993 |
| CN | 1925715 A | 3/2007 |

(Continued)

OTHER PUBLICATIONS

English Language Abstract for JP 2003133087 A, May 9, 2003.

(Continued)

*Primary Examiner* — Tung X Le

(57) ABSTRACT

In various embodiments, a dimmable operating device for the combined operation of a gas discharge lamp and a semiconductor light source is provided. The dimmable operating device may be configured such that only the semiconductor light source is operated in the lower dimming range and only the gas discharge lamp is operated in the upper dimming range, and at the changeover points at which one sort of light source out of the semiconductor light source and the gas discharge lamp is switched off or on, at the same time a jump in power is applied to the other light source out of the semiconductor light source and the gas discharge lamp, with the result that the human eye cannot perceive, or can only perceive with difficulty, the changeover point.

11 Claims, 2 Drawing Sheets

U.S. PATENT DOCUMENTS

| | | | | |
|---|---|---|---|---|
| 2005/0067982 | A1* | 3/2005 | Pilz | 315/294 |
| 2006/0007109 | A1 | 1/2006 | Noritake | |
| 2006/0007682 | A1* | 1/2006 | Reiff et al. | 362/253 |
| 2006/0238136 | A1 | 10/2006 | Johnson, III et al. | |
| 2008/0224635 | A1* | 9/2008 | Hayes | 315/297 |
| 2008/0259596 | A1 | 10/2008 | Biebl et al. | |

FOREIGN PATENT DOCUMENTS

| | | | |
|---|---|---|---|
| JP | 2003133087 | A | 5/2003 |
| JP | 2006003797 | A | 1/2006 |
| JP | 2006019060 | A | 1/2006 |
| WO | 2006086967 | A1 | 8/2006 |

OTHER PUBLICATIONS

English Language Abstract for JP 2006019060 A, Jan. 19, 2006.
International Search Report of PCT/EP2008/052290 mailed on Jul. 7, 2008.
English language abstract of CN 1925715 a dated Mar. 7, 2007.
English language abstract of CN 2146829 Y dated Nov. 17, 1993.

* cited by examiner

OPERATING DEVICE AND METHOD FOR THE COMBINED OPERATION OF GAS DISCHARGE LAMPS AND SEMICONDUCTOR LIGHT SOURCES

RELATED APPLICATIONS

The present application is a national stage entry according to 35 U.S.C. §371 of PCT application No.: PCT/EP2008/052290 filed on Feb. 26, 2008, which claims priority from German application No.: 10 2007 013 742.9 filed on Mar. 22, 2007.

BACKGROUND

The invention relates to the field of dimmable operating devices for light sources, specifically to dimmable operating devices for the combined operation of gas discharge lamps and semiconductor light sources.

Until now, each light source has been considered individually in the case of luminaires which also use semiconductor light sources such as light-emitting diodes in addition to the gas discharge lamps which have long been used. In the case of dimmable luminaires, each light source can be dimmed individually, but both light sources are not considered to be one unit.

U.S. Pat. No. 7,052,157 B1 has disclosed a luminaire in which LEDs are also used in addition to compact fluorescent lamps. The light sources can be dimmed independently of one another. A common dimming mechanism in which both types of light source are used is not described here.

Although fluorescent lamps can be dimmed with a corresponding degree of technical complexity down to 1% of the nominal light, the efficiency is reduced considerably at these low dimming settings. The color locus of the emitted light can also change since, at very low powers, the lamp cools down to a significant extent and it gives more weight to the argon discharge in comparison with the mercury discharge.

It is therefore desirable to provide a light source which can be dimmed more effectively, such as a semiconductor light source, for example, for very low dimming settings. In order to keep the complexity of the driving of the two light sources low, it is expedient to operate both light sources using one operating device.

SUMMARY

In various embodiments a dimmable operating device for the combined operation of a gas discharge lamp and a semiconductor light source is provided. The dimmable operating device may be configured such that only the semiconductor light source is operated in the lower dimming range and only the gas discharge lamp is operated in the upper dimming range, and at the changeover points at which one light source out of the semiconductor light source and the gas discharge lamp is switched off or on, at the same time a jump in power is applied to the other light source out of the semiconductor light source and the gas discharge lamp, with the result that the human eye cannot perceive, or can only perceive with difficulty, the changeover point.

Various embodiments provide a dimmable operating device for the combined operation of gas discharge lamps and semiconductor light sources which includes common dimming control for both light sources, by means of which dimming control the light emitted by the light-emitting means of the operating device can be dimmed down from a nominal luminous intensity to 1‰ or less.

For this purpose the operating device in various embodiments may include circuits which can operate both light-emitting means with dimming. An input which can represent an interface to an analog or digital light control bus may be provided for the dimming control. A 1-10 V bus may generally be used as the analog bus, and the DALI protocol may usually be used as the digital interface. The digital interface may also identify light control commands and light scenarios which are stored in the operating device. If a signal is input to this input, the operating device may control the light emission of the two light sources corresponding to the input dimming level.

In this case, one light-emitting means or the other is used, depending on the dimming level, and internal control ensures that the transition from one light-emitting means to the other is hidden from the human eye. Both light-emitting means are used for a certain dimming range in order to be able to realize a very soft transition.

BRIEF DESCRIPTION OF THE DRAWING(S)

DETAILED DESCRIPTION

First Embodiment

Figure 1:
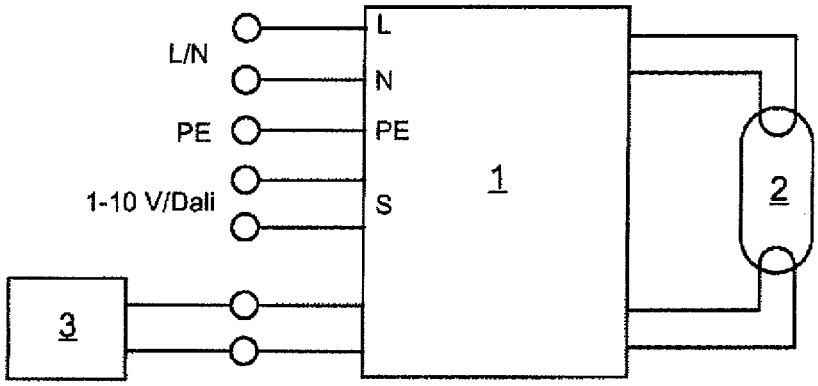
FIG. 1 shows a schematic illustration of a hybrid system according to the invention.
Figure 3:
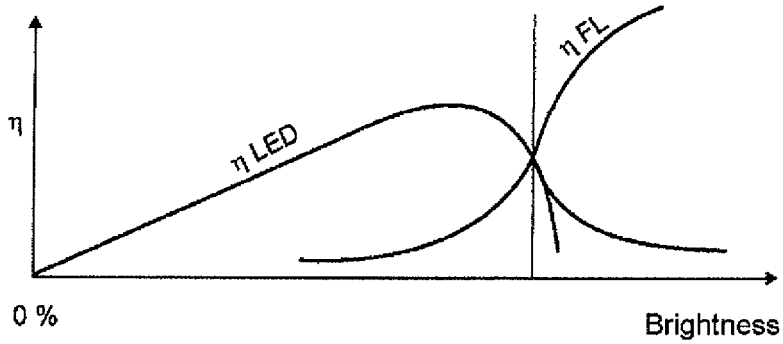
FIG. 3 shows a graph illustrating a further changeover criterion: the specific efficiency of the light sources.

FIG. 1 shows a schematic connection diagram of an operating device 1 according to various embodiments. The device has outputs for gas discharge lamps 2 and for semiconductor light sources 3. The gas discharge lamps 2 may be compact fluorescent lamps, and the semiconductor light sources 3 can be, for example, LEDs or OLEDs emitting white light. It is naturally also possible for only one gas discharge lamp 2 and one semiconductor light source 3 or one gas discharge lamp 2 and a plurality of semiconductor light sources 3 to be used. In addition to the system voltage input, there is an input for a light control interface. This light control interface can be a digital or an analog interface. However, it is also possible to program the interface to one light control protocol or another. This has the advantage of the greatest possible versatility of the operating device.

The two different light sources should be positioned in the luminaire in such a way that the light distribution of the two light-emitting means is similar. Only in this way can the luminaire be dimmed in a wide range without any physical optical discrepancies.

Figure 2:
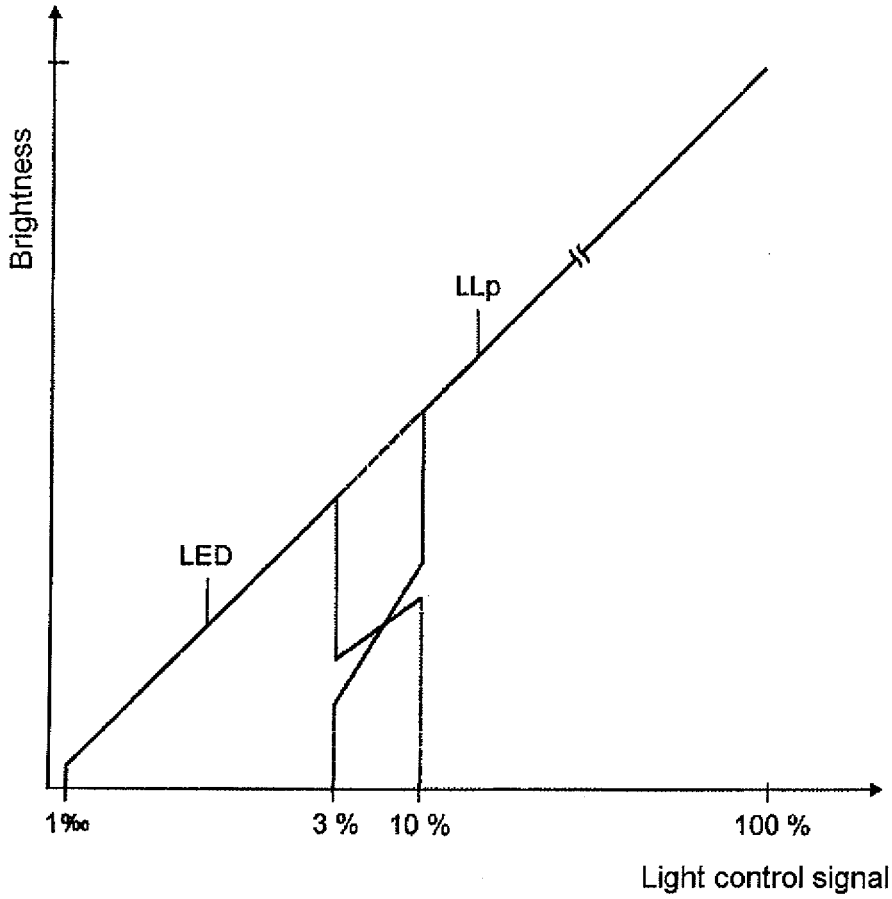
FIG. 2 shows a graph illustrating the transition from the semiconductor light sources to the gas discharge lamps.

FIG. 2 shows a graph illustrating the basic procedure in the transition from the LEDs to the gas discharge lamps. The dimming setting of a light control signal over overall brightness is shown. Both types of light source operated by the device are driven via a light control signal. The two curves for the semiconductor light sources and the gas discharge lamps run over large ranges on the light control signal, i.e. in all ranges outside the dimming range of 3%-10%, in each case the light emission of the semiconductor light sources or the gas discharge lamps precisely follows the prescribed value of the light control signal. The light control signal ends at the lower and upper ends since there is no longer any correlation between the signal and the brightness. In the range between 3% and 10%, both types of light source contribute to the system light emission. In this case, the light sources are each dimmed in such a way that the overall luminous intensity corresponds to the prescribed value of the light control signal.

The LEDs or OLEDs emit light in the lower dimming range, for example from 1% to 10%. Above a dimming setting of 3%, the gas discharge lamps are additionally connected. At the time of starting of the lamps, simultaneously the luminous efficiency of the LEDs is reduced suddenly in order not to change the overall luminous intensity of the luminaire. In order to compensate as well as possible for the short flash of light from the gas discharge lamp which it emits during starting, it would also be conceivable to entirely disconnect the LEDs for the instant of lamp starting. In the range between 3% and 10%, both light-emitting means are run up successively in terms of their luminous efficiency. At the dimming setting of 10%, the LEDs are disconnected and the power of the gas discharge lamp is increased suddenly in order again to maintain the quantity of light emitted. From this point on, the gas discharge lamp is dimmed down to its rated power.

Second Embodiment

These measures ensure that the transitions between the categories of light-emitting means can barely be perceived by the human eye. However, there is still a problem as regards the color locus of the emitted light. Although fluorescent lamps have a defined color locus at a rated power, this can change depending on the dimming state. Primarily at low dimming settings the lamp cools down. This results in the mercury discharge dropping off since the mercury condenses out at cool points on the lamp and is therefore no longer available for the discharge. However, the proportion of argon discharge therefore increases, which results in a migration of the color locus into the red.

The transition between the two categories of light-emitting means can therefore become visible despite the same brightness. This is primarily the case if the luminaire has been operated for a relatively long period of time in the lower dimming range, in which the gas discharge lamp is dimmed to a significant degree or entirely switched off. The lamp then cools down and changes its color or is cooled down at the start to such an extent that it emits a slightly different color than during nominal light operation.

The operating device in the second embodiment therefore has outputs for light-emitting diodes of different colors. There are preferably three outputs for diodes emitting colored light. These diodes can then emit red, green and blue light, and the light of all of the semiconductor light sources can thus be matched to the light color of the gas discharge lamp.

For this purpose, a family of characteristics which describes the dependence of the temperature of the gas discharge lamp as a function of the dimming setting, the time and the color locus can be stored in the operating device. At low dimming settings at which the semiconductor light sources are switched on, the operating device then sets the color locus of the semiconductor light sources which emit light of different colors to the color locus of the gas discharge lamp. The semiconductor light sources can naturally be organized in groups, with the result that a plurality of semiconductor light sources are also provided for each color.

Another possibility consists in using a sensor for the overall brightness and the color locus and controlling the lamps in such a way that the values for the individual brightnesses, for the overall brightness and for the two color loci of the different light sources can be measured and adjusted. For this purpose, the measurements need to be conducted when only the light-emitting means to be measured is switched on. This is relatively simple in the lower dimming range since the light sources are driven by pulses and there are therefore always times at which only the light-emitting means to be measured is emitting light. If no suitable time results from the driving, the control of the operating device can switch off all of the light-emitting means which are not to be measured for a measurement. Since this period of time is very short, it cannot be perceived by the human eye.

The invention claimed is:

1. A dimmable operating device for the combined operation of a gas discharge lamp and a semiconductor light source, wherein the dimmable operating device is configured such that only the semiconductor light source is operated in the lower dimming range and only the gas discharge lamp is operated in the upper dimming range, and at the changeover point at which one light source out of the semiconductor light source and the gas discharge lamp is switched off or on, at the same time a jump in power is applied to the other light source out of the semiconductor light source and the gas discharge lamp, with the result that the changeover point is imperceptible to the human eye, or is only perceptible with difficulty.

2. The dimmable operating device as claimed in claim 1, wherein the point at which the efficiencies of the semiconductor light source and the gas discharge lamp are approximately equal is in the dimming range in which the semiconductor light source and the gas discharge lamp are switched on.

3. The dimmable operating device as claimed in claim 1, wherein the operating device has three outputs for a plurality of semiconductor light sources which emit monochromatic light.

4. The dimmable operating device as claimed in claim 3, configured to store a family of characteristics which describes the dependence of the temperature of the gas discharge lamp as a function of the dimming setting, the time and the color locus in the operating device, and wherein the operating device is configured to set the color locus of the gas discharge lamp at dimming settings at which the semiconductor light source is switched on, via corresponding driving of the three semiconductor light sources which emit light of different colors.

5. The dimmable operating device as claimed in claim 3, wherein the operating device is configured to measure the color locus of the gas discharge lamp at dimming settings at which the semiconductor light source is switched on and at a time at which precisely no semiconductor light source emits light, and to set the semiconductor light source to this color locus.

6. The dimmable operating device as claimed in claim 5, wherein the operating device is further configured to measure the brightness of the gas discharge lamp and of the semiconductor light source as well as the color locus of the semiconductor light source at suitable times and to adjust the semiconductor light source in such a way that the brightness and the color locus correspond to the desired values.

7. The dimmable operating device as claimed in claim 1, wherein the semiconductor light source comprises an inorganic light-emitting diode.

8. The dimmable operating device as claimed in claim 1, wherein the semiconductor light source comprises an organic light-emitting diode.

9. The dimmable operating device as claimed in claim 1, wherein the operating device has a control interface to which a control signal is input, wherein the operating device is configured to convert the control signal into an internal light control signal and the semiconductor light source as well as the gas discharge lamp being dimmed by this light control signal.

10. A method for operating and dimming a semiconductor light source and a gas discharge lamp, the method comprising: exclusively operating the semiconductor light source in the lower dimming range; exclusively operating the gas discharge lamp in the upper dimming range; and providing a range in which the semiconductor light source and the gas discharge lamp are operated, the changeover point at which one light source out of the semiconductor light source and the gas discharge lamp is switched on and the other light source out of the semiconductor light source and the gas discharge lamp is switched off to retain the same overall brightness of the system.

11. The method as claimed in claim 10, wherein the point at which the efficiencies of the semiconductor light source and the gas discharge lamp are approximately equal is in the dimming range in which the semiconductor light source and the gas discharge lamp are switched on.

* * * * *